US005882578A

United States Patent [19]

Fuchs et al.

[11] Patent Number: 5,882,578

[45] Date of Patent: Mar. 16, 1999

[54] TILTING METALLURGICAL UNIT COMPRISING SEVERAL VESSELS

[75] Inventors: Gerhard Fuchs, Kehl-Bodersweier; Joachim Ehle, Lautenbach, both of Germany

[73] Assignee: ARCMET Technologie GmbH, Linz, Austria

[21] Appl. No.: 849,484

[22] PCT Filed: Dec. 21, 1995

[86] PCT No.: PCT/EP95/05072

§ 371 Date: Sep. 11, 1997

§ 102(e) Date: Sep. 11, 1997

[87] PCT Pub. No.: WO96/19592

PCT Pub. Date: Jun. 27, 1996

[30] Foreign Application Priority Data

Dec. 21, 1994 [DE] Germany ..... 44 45 783.9

[51] Int. Cl.[6] ..... C21C 5/50

[52] U.S. Cl. ..... 266/143; 266/168; 266/240

[58] Field of Search ..... 266/168, 236, 266/240, 142, 143

[56] References Cited

U.S. PATENT DOCUMENTS 682,512 9/1901 Wellman ..... 266/240

4,740,989 4/1988 Steipe et al. ..... 373/2

FOREIGN PATENT DOCUMENTS 0 240 485 10/1987 European Pat. Off. .

0 385 434 9/1990 European Pat. Off. .

25 04 911 9/1976 Germany .

33 22 485 12/1983 Germany .

2-290912 11/1990 Japan .

*Primary Examiner*—Scott Kastler

*Attorney, Agent, or Firm*—Lahive & Cockfield, LLP

[57] ABSTRACT

A metallurgical unit for smelting metal charge material and for post-treatment of the molten metal, which is tiltable from a starting position in a positive tilting direction (8) about a tilt axis (7), includes a melting vessel (1), with a furnace hearth (12) for receiving the molten metal (13), and a treatment vessel (2) disposed laterally on the melting vessel for metallurgical treatment of the molten metal. The molten metal (13) which flows away out of the melting vessel (1) upon tilting of the unit in the positive direction (8) can be transferred into the treatment vessel (2) by way of a passage (26) connecting the furnace hearth of the melting vessel (1) to the receiving chamber of the treatment vessel (2).

15 Claims, 5 Drawing Sheets

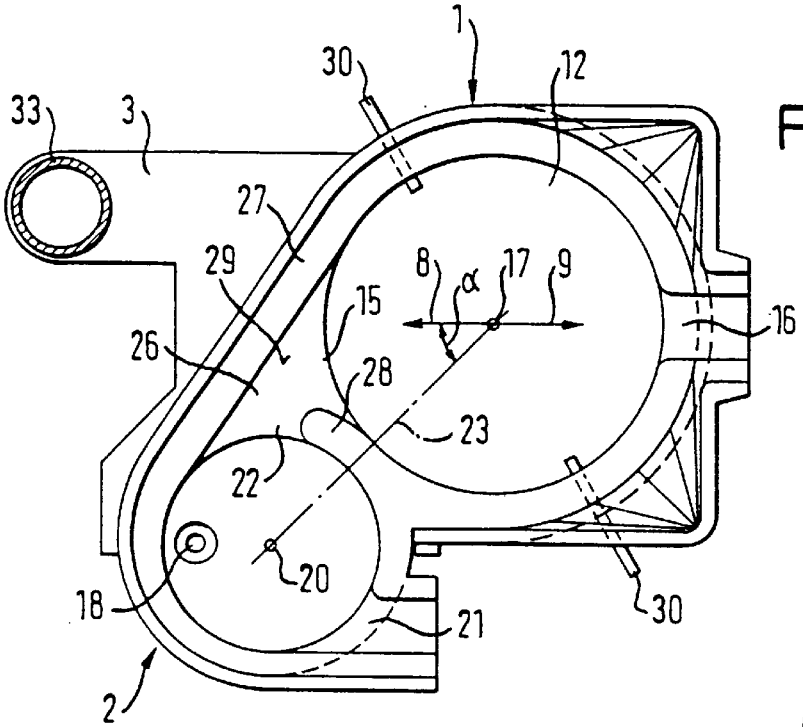
FIG. 3
FIG. 4
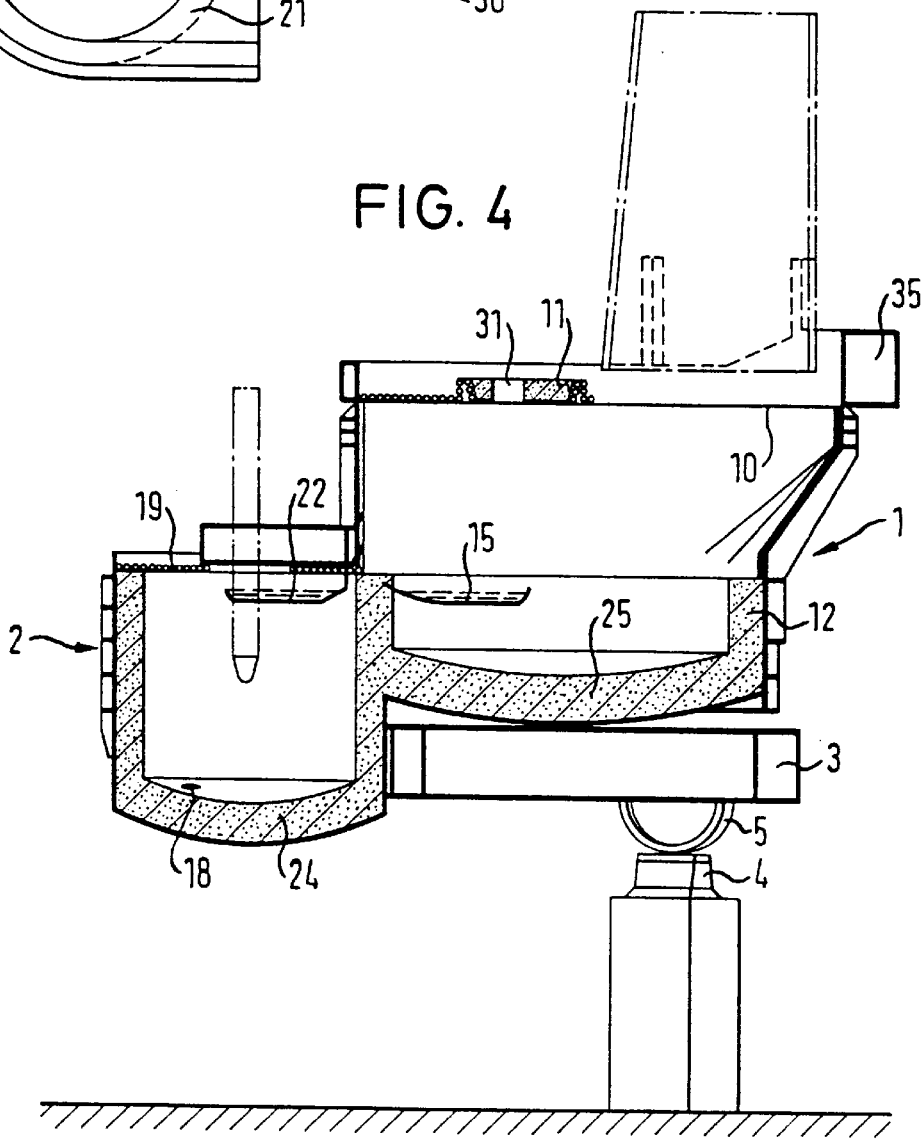

TILTING METALLURGICAL UNIT COMPRISING SEVERAL VESSELS

BACKGROUND OF THE INVENTION

The invention concerns a tiltable metallurgical unit for smelting metal charge material, in particular ferrous material, and for post-treatment of the molten metal.

EP-0 240 485-Bl discloses an installation for the production of steel from scrap and possibly additive materials, comprising a blast furnace portion which has a bottom for receiving a liquid sump of pre-molten material and heating devices which open laterally into the lower portion of its interior, and with a hearth furnace portion which is integrally interconnected with the blast furnace portion and into which the pre-molten material can be transferred from the blast furnace portion. The hearth furnace portion directly adjoins the lower part of the blast furnace portion. Disposed between the lower blast furnace portion and the hearth furnace portion is an overflow weir by way of which pre-molten material which has collected in the trough or basin of the blast furnace portion continuously flows away into the hearth furnace portion, the bottom of which is arranged lower than the bottom of the blast furnace portion. The entire unit consisting of the blast furnace portion and the hearth furnace portion is tiltable, more specifically perpendicularly to a horizontal axis connecting the centre of the blast furnace portion to the centre of the hearth furnace portion. The hearth furnace portion has an eccentrically arranged bottom tapping for the steel and, in the side wall, a working door for drawing off the slag. Both the lower part of the blast furnace portion and also that of the hearth furnace portion have an interior which is circular in plan view, wherein the interior of the blast furnace portion is approximately tangential to the interior of the hearth furnace portion in plan and the transition from one interior into the other is of a reduced configuration. The heating means for the hearth furnace portion is an arc unit while the heating means for the blast furnace portion is a plurality of plasma burners which are arranged in the lower region of the shaft furnace portion distributed along the periphery thereof.

The bottom depression of the blast furnace portion is of a relatively shallow configuration and the upper edge of the overflow weir is of low height in relation to the bottom depression so that, at the beginning of a melting operation, only a small amount of the pre-molten material is retained in the bottom depression of the blast furnace portion and, after sump formation, the pre-molten material flows away continuously into the hearth furnace portion over the overflow weir. In order to prevent the molten material from congealing in the region of the overflow weir, on the one hand the inclination of the plasma burners is so set that the pre-molten material is overheated in a direction towards the overflow weir and on the other hand there is also a plasma burner between the blast furnace portion and the hearth furnace portion so that the pre-molten material can be overheated in the region of the overflow weir and a continuous discharge flow of the pre-molten material is guaranteed.

The metallurgical treatment in the hearth furnace portion begins as soon as half the bath depth is reached here. The molten material is heated to the tapping temperature by the additional supply of electrical energy. During that procedure pre-molten material continuously flows thereto from the blast furnace portion. When the tapping weight is reached in the hearth furnace portion, the material is tapped off in a slag-free condition by tilting of the unit, by way of an eccentric bottom tapping opening.

In the known installation, additional heat energy has to be supplied in the region of the overflow weir in order to prevent the premolten material from congealing in that region. In addition, during the treatment of the pre-molten material in the hearth furnace portion it is continuously supplied with pre-molten material which is subject to serious fluctuations in regard to its composition and temperature so that the treatment procedure in the hearth furnace is adversely affected thereby. Finishing of the molten material (deoxidation, further desulphurisation and alloying) is therefore to be effected outside the hearth furnace portion, for example during tapping into a ladle.

DE-25 04 911-A1 discloses an apparatus for smelting scrap, sponge iron or the like in a blast furnace by means of a fuel-oxygen flame from below and with an outlet for the molten material in the bottom of the blast furnace for the continuous production of steel, in which a heating vessel which is mounted laterally in relation to the blast furnace is integrated therewith. At the lowest point of its bottom the blast furnace has an outlet for molten metal which is connected to the superheating vessel by way of a passage and also a slag discharge in the side wall. The superheating vessel is provided with an overflow means which is disposed slightly beneath the level of the slag outlet. The liquid metal which is superheated in the superheating vessel flows away continuously by way of the overflow means and is continuously replaced by the liquid metal which is melted in the blast furnace, by way of a connecting passage to the blast furnace. The superheating vessel is heated by means of arcs.

The object of the present invention, in a metallurgical unit of the kind described in the opening part of this specification, is to prevent congealing of the molten material in the transfer region between the melting and the treatment vessels without additional heat energy having to be supplied to that region. The invention further seeks to provide that an adverse effect on the treatment procedure on the molten material in the treatment vessel, which is caused by a continuous feed flow of pre-molten metal which fluctuates severely in terms of its composition can be prevented. The invention further seeks to provide that the melting vessel and the treatment vessel can be of an optimum configuration and mode of operation, independently of each other, in terms of their aim. Finally the invention seeks to provide that the energy consumption of the unit per tonne of metal produced is minimised and the hot waste gases from the treatment vessel as well as the melting vessel can be put to use for preheating the charge material.

SUMMARY OF THE INVENTION

In the unit according to the invention, a melting vessel which includes a furnace hearth for receiving a substantial part and preferably the entire amount of a furnace charge and a treatment vessel disposed laterally on the melting vessel for receiving the molten metal from the furnace hearth of the melting metal and for metallurgical treatment of the molten metal are combined to form a unit which can be tilted about a tilt axis or rolled along a rolling path. When the unit is tilted the molten metal in the melting vessel can be transferred into the treatment vessel by way of a passage between the melting vessel and the treatment vessel, which is arranged at such a height that the desired amount of molten metal can be retained in the melting vessel. Transfer of the molten metal is therefore not effected continuously by way of an overflow weir but in a batch-wise manner only when the desired amount of molten metal has accumulated in the melting vessel. When the unit is tilted the hot molten metal flows through the passage to the treatment vessel in a short period of time so that the risk of the metal cooling down does not occur here. During the operation of smelting solid charge material in the melting vessel the molten material which has been transferred into the treatment vessel in the previous tilting procedure is subjected to metallurgical treatment so that the both processes take place in parallel, in which respect the melting vessel can be optimised in its size and equipment in regard to the melting process and the treatment vessel can be optimised in that way in regard to the metallurgical treatment. The supply of heat to the two vessels, which can be effected by burning fossil fuels, a feed of oxygen-bearing gases and possibly coal through bottom bricks or under-bath nozzles and by means of electrical energy should be so matched that the smelting time approximately corresponds to the treatment time so that after the operation of tapping the treatment vessel the molten metal formed in the melting vessel can be transferred into the treatment vessel by tilting of the unit and the parallel mode of operation of the two vessels can be continued immediately thereafter. As, during the smelting process, the molten metal formed in the melting vessel does not overflow into the treatment vessel, but the procedure involved in transferring the molten metal is controlled by the tilting movement of the unit, the metallurgical treatment in the treatment vessel is not disturbed by molten metal flowing thereto.

So that the unit can be of a compact configuration and so that the masses which are to be moved in the tilting movement can be minimised, it is desirable to arrange the treatment vessel not in alignment with the melting vessel in the tilting direction or in a direction perpendicular to the tilting axis of the unit, but laterally displaced in relation thereto, so that in a plan view the connecting line between the centre points of the vessels and the direction of tilting movement of the unit includes an acute angle. Preferably that angle is about 45°. The passage between the two vessels however should be so arranged that, viewed from the melting vessel in plan, a line in the tilting direction through the centre point of the melting vessel is still within the intake opening of the passage to the treatment vessel. That position of the vessel periphery is at the lowest in the tilting movement and thereby permits better emptying of the melting vessel, with a predetermined angle of tilt.

Preferably the unit can be tilted from its starting position not only in the above-described positive tilting direction in which the molten metal can be transferred from the melting vessel into the treatment vessel, but also in the reverse, negative tilting direction in order to permit slag to be taken from the vessels. For that purpose working openings or slag openings respectively are provided at suitable locations.

As already mentioned it is advantageous if the sole of the connecting passage between the melting vessel and the treatment vessel is at such a height that the two vessels can be operated in parallel without molten metal overflowing from the melting vessel into the treatment vessel. The sole of the connecting passage should be higher than the bottom of the melting vessel by a distance which, in the starting position of the unit, permits the molten metal to be retained in the furnace hearth of the melting vessel in an amount of at least half the capacity of the treatment vessel and preferably the entire capacity thereof.

It is also advantageous if in the starting position of the unit the bottom of the post-treatment vessel is lower than the bottom of the melting vessel in order to be able to transfer all the molten metal from the melting vessel into the treatment vessel in the tilting process. The melting vessel will be of a larger diameter than the treatment vessel, having regard to the prescribed working procedures.

In order to permit good access from above the connecting passage between the two vessels should be in the form of an upwardly open channel in a partition wall of refractory material between the two vessels.

As already mentioned different energy carriers can be used as the heat sources for the two vessels. Preferably, arc energy is also used besides other energy sources, in which respect it is advantageous if the electrode carrier mechanism is arranged on the same tilting frame as the two vessels so that the electrodes do not have to be removed from the vessels, at least upon tilting of the unit in the negative tilt direction, that is to say when taking off the slag. Preferably a lifting and pivoting assembly for at least one electrode is arranged beside the structural unit consisting of the melting vessel and the treatment vessel, so it can be selectively introduced into the melting vessel and the treatment vessel.

Desirably the hot waste gases from the treatment vessel and the melting vessel are utilised for preheating the charge material to be introduced into the melting vessel. That can be effected in a particularly compact and efficient manner by the cover of the melting vessel being fixed in a holding structure which at the same time carries a shaft which is in the form of a charging material preheater and whose lower opening communicates with the interior of the melting vessel. The hot waste gases which pass into the melting vessel from the treatment vessel by way of the connecting passage, particularly when the passage is in the form of an upwardly open channel, and the hot waste gases of the melting vessel are then passed upwardly through the shaft through a column of scrap which is formed in the region beneath and in the shaft, and the gases thereby preheat the charging material. In per se known manner the shaft may also have shut-off or closure members which are movable from a closure position for retaining charging material in the interior of the shaft into a release position in which they open the shaft for material to pass therethrough. When such a shaft is used the charging material can be retained in the shaft and the utilisation of heat can be still further improved.

The invention is described in greater detail by means of an embodiment with reference to six Figures which diagrammatically show various views of the subject-matter of the invention. In the drawing:

BRIEF DESCRIPTION OF THE DRAWINGS

FIG. 3 shows the section III—III in FIG. 2, FIG. 4 shows the section IV—IV in FIG. 1.

DETAILED DESCRIPTION OF THE PREFERRED EMBODIMENTS

Figure 1:
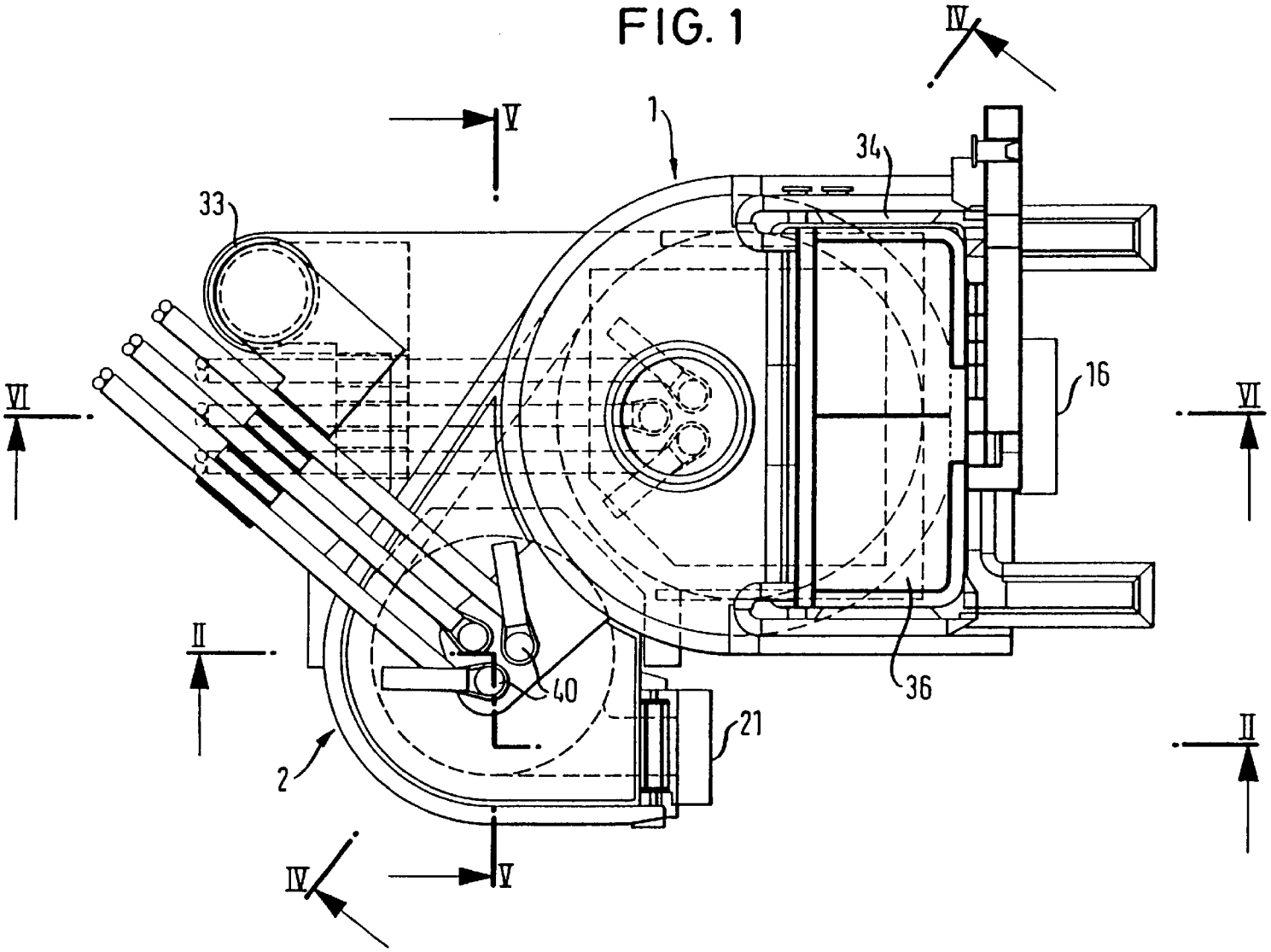
FIG. 1 is a plan view of the metallurgical unit according to this invention.
Figure 2:
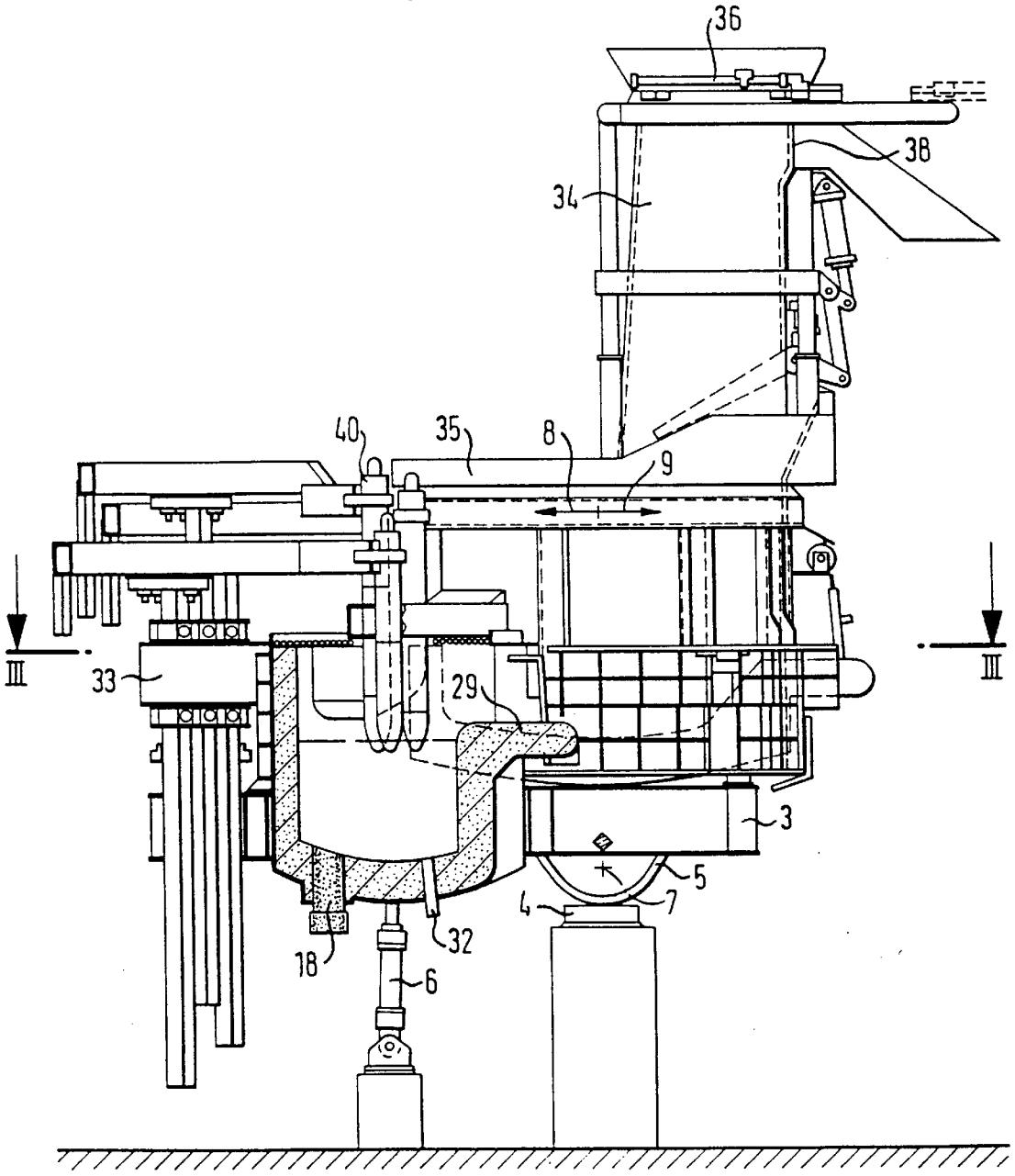
FIG. 2 shows the section II—II in FIG. 1.
Figure 5:
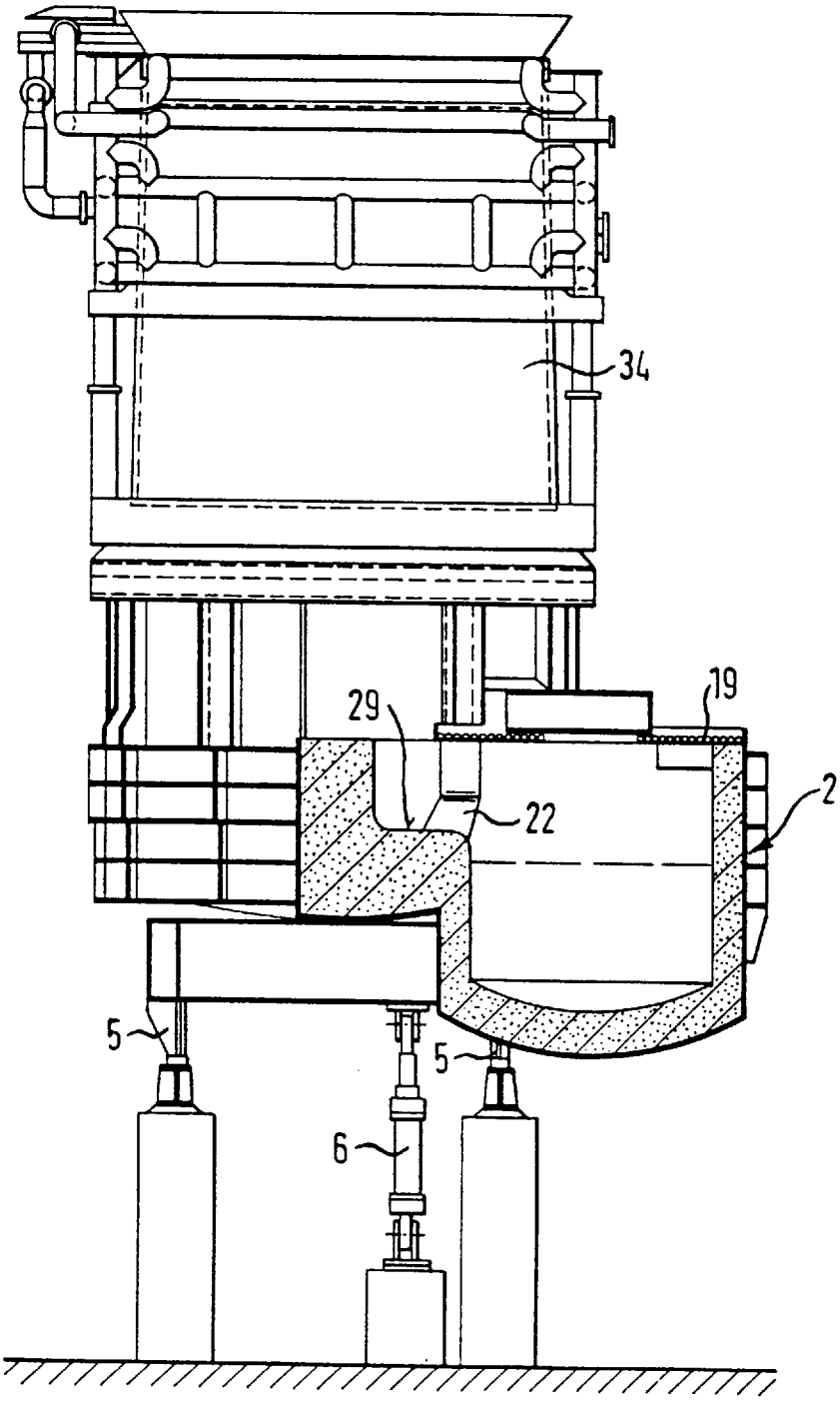
FIG. 5 shows the section V—V in FIG. 1.

As can be seen from FIGS. 1, 2 and 4 the metallurgical unit for smelting metal charge material and for the post-treatment of the molten metal includes a melting vessel 1 and a treatment vessel 2 which is disposed laterally on the melting vessel 1 and which is connected therewith to constitute a structural unit. The two vessels are fixed in a frame 3 which is mounted tiltably. For that purpose, in the present case the frame has a furnace cradle 5 which can be rolled on a rolling track or path 4, and a hydraulic control member 6 which engages the frame and with which the unit can be tilted about a horizontal tilt axis 7 from the starting position shown in FIGS. 2 and 4 both in a positive tilting direction 8 and also in a negative tilting direction 9, through a predetermined tilt angle.

Figure 6:
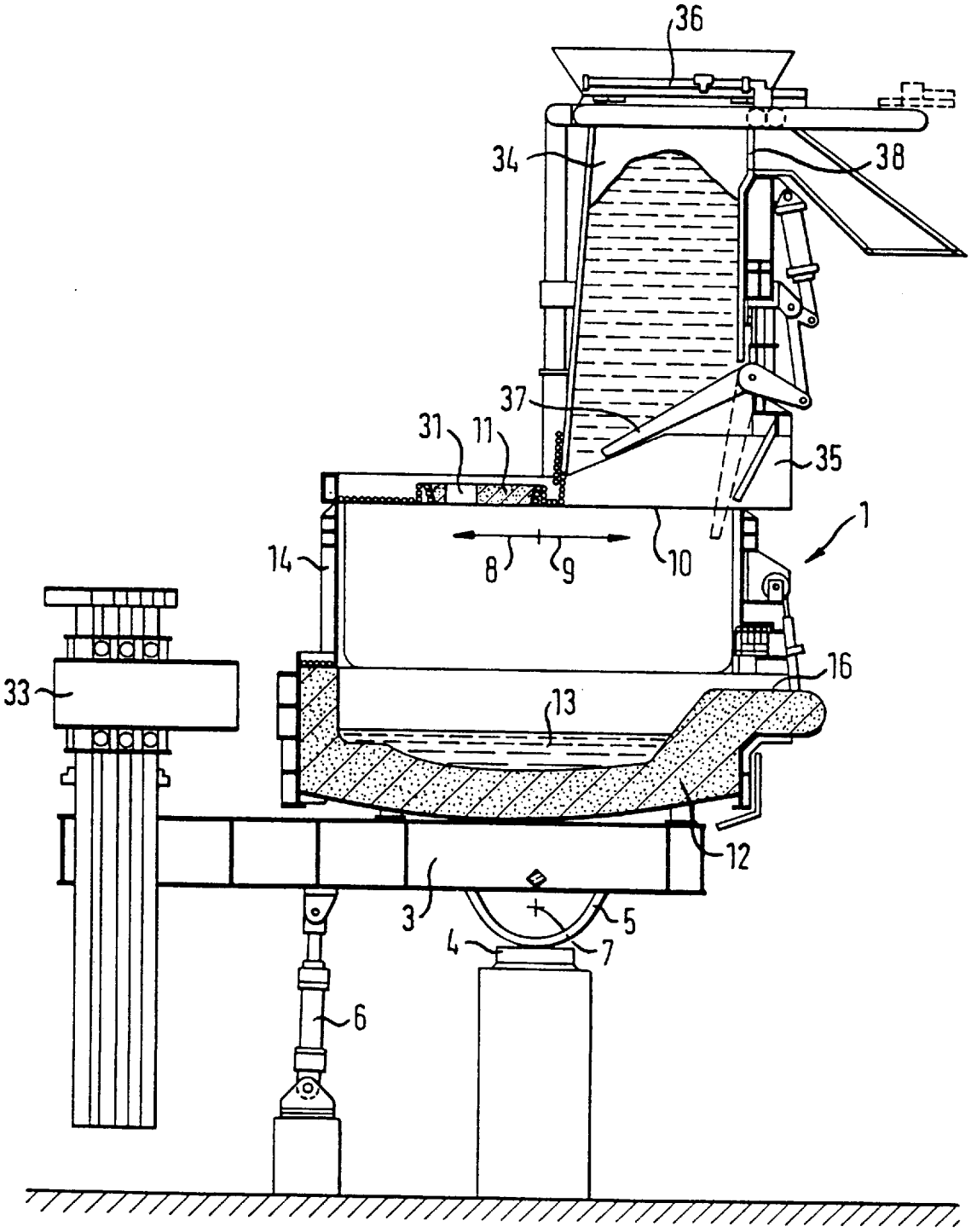
FIG. 6 shows the section VI—VI in FIG. 1.

As FIG. 6 shows, the melting vessel 1 is provided with a charging opening 10 for the introduction of the charge material, which is provided in the vessel cover 11, and includes a furnace hearth 12 for receiving molten metal 13. In the usual manner the furnace hearth 12 is formed from refractory material while the upper vessel 14 which is fitted on to the furnace hearth and the cover 11 comprise water-cooled elements.

As can best be seen from FIG. 3, provided in the side wall of the furnace hearth 12 is a discharge flow opening 15 for the removal of the molten metal and, disposed opposite same, a working opening 16 for the removal of slag from the melting vessel 1. In the plan view shown in FIG. 3 the discharge flow opening 15 is in the positive tilting direction 8 with respect to the centre point 17 of the vessel while the working opening 16 is in the negative tilting direction 9 so that, when the unit is tilted in the positive direction 8, the molten metal 13 can be discharged from the furnace hearth 12 and, when the unit is tilted in the negative direction 9, slag can be removed through the working opening 16.

The treatment vessel 2 mounted laterally on the melting vessel 1, for receiving the molten metal 13 from the furnace hearth 12, is lined with refractory material and forms a structural unit with the melting vessel 1, as the Figures clearly show. The treatment vessel is preferably of such a size that it is capable of receiving the maximum permissible volume of the molten metal from the melting vessel, the cross-section of the treatment vessel being substantially less than that of the melting vessel. The treatment vessel performs the function of a ladle, and in the bottom it has a tapping opening 18 and possibly gas flushing bricks or under-bath nozzles for the injection of treatment gases and solids (not shown), and it is covered with a water-cooled cover 19. While in the plan view shown in FIG. 3 the tapping opening 18 is arranged in the positive tilting direction 8 with respect to the centre point 20 of the treatment vessel 2, a working opening 21 is provided in the opposite half of the treatment vessel; slag can be removed from the treatment vessel by way of the working opening 21 when the unit is tilted in the negative tilting direction 9. The treatment vessel 2 has an intake opening 22 for the molten metal and is disposed in adjoining relationship beside the melting vessel in such a way that in plan view (see FIG. 3), relative to the centre point 17 of the melting vessel 1, the connecting line 23 between the vessel centre points 17 and 20 includes relative to the positive tilting direction 8 an acute angle $\alpha$ which in the illustrated case is about 45°. In that way it is possible for the vessel centre points 17 and 20 to be moved closer together with respect to the tilting direction, and thereby to concentrate the masses to be moved.

As FIG. 4 shows, in the non-tilted condition of the metallurgical unit, that is to say in the starting position thereof, the bottom 24 of the post-treatment vessel 2 is lower than the bottom 25 of the melting vessel 1, that is to say the furnace hearth 12. The discharge flow opening 15 of the melting vessel 1 is connected to the intake opening 22 of the treatment vessel 2 by a connecting passage 26 which is in the form of an upwardly open channel. From the point of view of structure, the channel is formed by virtue of the fact that the brick lining for the furnace hearth and the treatment vessel, the upper edges of which lie in the same plane, is connected by a tangential portion 27 between the two vessels and the upwardly open channel of the connecting passage 26 is provided adjoining the tangential connecting portion 27 in the partition wall 28 between the two vessels.

As FIG. 4 in particular shows, the sole of the connecting passage is a significant distance higher than the bottom 25 of the melting vessel 1. It should be at least so high that, in the starting position of the unit as illustrated in FIG. 4, at least half the capacity of the treatment vessel 2 can be retained in the furnace hearth 12 of the melting vessel 1.

For the feed of the heat energy required for smelting the metal charge material, associated with the melting vessel 1 is a first heating arrangement which can include arc electrodes, induction coils, burners, gas scavenging bricks, under-bath nozzles, blowing and post-combustion nozzles or other known heating arrangements for heating and melting the charge material. Representatively in respect of the first heating arrangement FIG. 3 indicates side wall burners 30 and FIGS. 4 and 6 indicate a through opening 31 in the vessel cover 11 for the introduction of an arc electrode 40.

A second heating arrangement is associated with the treatment vessel. The second heating arrangement may include the same energy sources as the first heating arrangement. The heating arrangements known from ladle metallurgy are preferred. Arc electrodes 40 are representatively illustrated in FIG. 2. Gases and also powdered solids can be introduced into the molten material for the treatment thereof by way of bottom scavenging bricks (not shown) or nozzles 32.

In the illustrated embodiment, a lifting and pivoting assembly 33 for three electrodes 40 is arranged beside the structural unit comprising the melting vessel 1 and the treatment vessel 2, in such a way that the electrodes can be selectively introduced into the melting vessel 1 and into the treatment vessel 2 and used therein as a first or a second heating arrangement respectively. As FIG. 3 in particular shows, the lifting and pivoting assembly 33 is fixed on the tilting frame 3 of the unit so that, when the unit is tilted, the electrodes do not have to be removed from the vessel in question.

As can best be seen from FIGS. 1 and 6 the melting vessel 1 has a charging material preheater 34. It is in the form of a shaft and is fixed in the holding structure 35 for the cover 11. The basic structure of such a melting vessel with integrated charging material preheater is described in WO 90/10 086. Accordingly a segment of the cover is replaced by a shaft, by way of which the metal charge material can be charged into the melting vessel. The lower opening of the shaft is at the same time the intake opening 10 of the melting vessel, which is provided in the cover 11. The charging material preheater 34 is closed at the top by a cover 36 which can be pushed to the side. The hot furnace exhaust gases which are passed through the charging material preheater are drawn off by way of an upper discharge opening 38.

In the embodiment illustrated in FIG. 6 the charging material preheater has shut-off or closure members 37 in the form of fingers which are disposed at a spacing in mutually juxtaposed relationship and which are pivotable downwardly from the closure position shown in solid lines in FIG. 6 into a release position shown in broken lines, in which they open the shaft to release a flow of material therethrough. In the closure position of the closure members 37 the charge material is retained in the charging material preheater and the hot furnace gases can flow therethrough; the hot furnace gases enter the column of charging material from below through the intermediate spaces between the closure members 37 and are drawn off by way of the discharge opening 38, after having given off their heat.

The mode of operation of the described unit is described hereinafter.

On the assumption that a molten metal (molten iron) has been subjected to metallurgical treatment in the treatment vessel 2 while at the same time an amount of charge material (steel scrap) which corresponds to the content of the treatment vessel has been smelted in the melting vessel 1, and in addition the charge material which is retained by the closure members 37 has been heated in the charging material preheater 34, the following process steps take place:

1. The molten metal, the treatment of which has been finished, is tapped off by way of the tapping opening 18 and thereafter the tapping opening is closed again.

2. By tilting movement of the unit in the positive tilting direction 8 the molten metal is transferred from the furnace hearth 12 by way of the connecting passage 26 into the treatment vessel and, upon or after the return tilting movement into the starting position, the preheated charge material is charged into the melting vessel by pivoting the closure members 37 into the release or open position.

3. The closure members 37 are pivoted back into their closure position and cold charge material is charged by way of the upper opening which has been opened by the cover 36 which is moved to the side, and the opening is then closed again.

4. The electrodes 40 are introduced into the treatment vessel 2 and the treatment process is initiated, in which case the hot furnace exhaust gases flow by way of the connecting passage 26 into the melting vessel, here give off sensitive heat to the charge material and are then passed through the charge material column in the charging material preheater 34, for making further use of the heat involved. Simultaneously with the supply of heat by the second heating arrangement into the treatment vessel—a part of the heat can be supplied by injecting oxygen through under-bath nozzles, scavenging bricks and lances—the supply of heat by the first heating arrangement, that is to say in the present case through the burners 30, into the smelting vessel, is effected in order to smelt the material in that vessel. The hot furnace gases which are produced in that case are also passed through the charge material which is retained in the charging material preheater.

5. After an adequate supply of heat by the electrodes 40 into the treatment vessel 2 the electrodes are pulled out of the treatment vessel by the electrode lift and pivoting assembly, pivoted to the side and introduced into the melting vessel 1 in order there to assist the burner effect and accelerate the smelting procedure.

6. At the end of the smelting procedure, when the bath level has almost reached the sole 29 of the connecting passage and the treatment procedure in the treatment vessel is almost concluded, the electrodes are pivoted back to the treatment vessel again and the unit is tilted in the negative tilting direction for taking off the slag. Described process steps 1 to 6 are thereafter repeated.

We claim:

1. A metallurgical unit for smelting metal charge material and for the post-treatment of the molten metal, which can be tilted from a starting position in a positive tilting direction (8) about a tilt axis (7) and can be rolled along a rolling track (4), including:

a) a melting vessel (1) which is provided with a charging opening (10) for introduction of the charge material and which includes a furnace hearth (12) for receiving the molten metal (13), in the side wall of which is arranged a discharge flow opening (15) for removal of the molten metal (13) from the furnace hearth when the unit is tilted, b) a first heating arrangement (30, 38) associated with the melting vessel for smelting the charge material, c) a treatment vessel (2) disposed laterally on the melting vessel for receiving the molten metal from the furnace hearth (12) of the melting vessel (1) and for the metallurgical treatment, which includes an intake opening (22) for the molten metal and a tapping opening (18), d) a second heating arrangement (38) associated with the treatment vessel for the metallurgical treatment of the molten metal, and e) a passage (26) which connects the discharge flow opening (15) of the melting vessel (1) to the intake opening (22) of the treatment vessel (2) and includes a sole (29) having a height which is higher than the bottom (25) of the melting vessel (1) by an amount that retains the molten metal (13) in the furnace hearth (12) of the melting vessel (1) of at least half the capacity of the treatment vessel (2) when the metallurgic unit is in the non-tilted condition (starting position), wherein in plan view the connecting line (23) from the center point (17) of the melting vessel (1) to the center point (20) of the treatment vessel (2) includes an acute angel ($\alpha$) relative to the positive tilting direction (8) of the unit.

2. A metallurgical unit according to claim 1 characterized in that for removal of slag it can be tilted or rolled in a negative tilting direction (9) which is opposite to the positive tilting direction (8).

3. A metallurgical unit according to claim 1 characterised in that in plan view a line drawn relative to the positive tilting direction (8) through the centre point (17) of the melting vessel (1) intersects the vessel wall thereof in the region of the discharge flow opening (15).

4. A metallurgical unit according to claim 1 characterised in that the wall of the melting vessel (1) has a working opening (16) on the side opposite to the discharge flow opening (15).

5. A metallurgical unit according to claim 1 characterised in that the tapping opening (18) of the treatment vessel (2), relative to the positive tilting direction (8), is arranged eccentrically in the outer edge region of the bottom (24) of the treatment vessel (2).

6. A metallurgical unit according to claim 1 characterised in that the wall of the treatment vessel (2) has a working opening (21) in the negative tilting direction (9), with respect to the vessel centre (29).

7. A metallurgical unit according to claim 1 characterised in that in the starting position of the unit the bottom (24) of the treatment vessel (2) is lower than the bottom (25) of the melting vessel (1).

8. A metallurgical unit according to claim 1 characterised in that the connecting passage (26) is in the form of an upwardly open channel in a partition wall (28) of refractory material between the two vessels (1 and 2).

9. A metallurgical unit according to claim 1 characterised in that a lifting and pivoting assembly (33) for at least one electrode (40) which can be selectively introduced into the melting vessel (1) and the treatment vessel (2) is arranged beside the structural unit comprising the melting vessel (1) and the treatment vessel (2).

10. A metallurgical unit according to claim 1 characterised in that the lifting and pivoting assembly (33) for the electrode (40) is arranged on a tiltable frame (3) carrying the structural unit comprising the melting vessel (1) and the treatment vessel (2).

11. A metallurgical unit according to claim 1 characterised in that nozzles (32) open into the treatment vessel (2) for injecting gases and solids.

12. A metallurgical unit according to claim 1 characterised in that a cover (11) of the melting vessel (1) is fixed in a holding structure (35) which at the same time carries a shaft which is in the form of a charging material preheater (34) and whose lower opening opens into the interior of the melting vessel (1).

13. A metallurgical unit according to claim 12 characterised in that the charging material preheater (34) has shut-off members (37) which are movable from a closure position for retaining charging material in the interior of the charging material preheater (34)into a release position in which they open the shaft for the charge material to pass through the charging material preheater.

14. A metallurgical unit for smelting metal charge material and for the post-treatment of the molten metal, which can be tilted from a starting position in a positive tilting direction (8) about a tilt axis (7) or can be rolled along a rolling track (4), including:

a) a melting vessel (1) which is provided with a charging opening (10) for introduction of the charge material and which includes a furnace hearth (12) for receiving the molten metal (13), in the side wall of which is arranged a discharge flow opening (15) for removal of the molten metal (13) from the furnace hearth when the unit is tilted, b) a first heating arrangement (30, 38) associated with the melting vessel for smelting the charge material, c) a treatment vessel (2) disposed laterally on the melting vessel for receiving the molten metal from the furnace hearth (12) of the melting vessel (1) and for the metallurgical treatment, which includes an intake opening (22) for the molten metal and a tapping opening (18), d) a second heating arrangement (38) associated with the treatment vessel for the metallurgical treatment of the molten metal, and e) a passage (26) which connects the discharge flow opening (15) of the melting vessel (1) to the intake opening (22) of the treatment vessel (2) and includes a sole (29) having a height which is higher than the bottom (25) of the melting vessel (1) by an amount that prevents transfer of the molten metal (13) between the furnace hearth (12) of the melting vessel (1) and the treatment vessel (2) by way of the passage when the metallurgic unit is in the non-tilted condition (starting position), wherein in plan view the connecting line (23) from the center point (17) of the melting vessel (1) to the center point (20) of the treatment vessel (2) includes an acute angel (cc) relative to the positive tilting direction (8) of the unit.

15. A metallurgical unit for smelting metal charge material and for the post-treatment of the molten metal, which can be tilted from a starting position in a positive tilting direction (8) about a tilt axis (7) or can be rolled along a rolling track (4), including:

a) a melting vessel (1) which is provided with a charging opening (10) for introduction of the charge material and which includes a furnace hearth (12) for receiving the molten metal (13), in the side wall of which is arranged a discharge flow opening (15) for removal of the molten metal (13) from the furnace hearth when the unit is tilted, b) a first heating arrangement (30, 38) associated with the melting vessel for smelting the charge material, c) a treatment vessel (2) disposed laterally on the melting vessel for receiving the molten metal from the furnace hearth (12) of the melting vessel (1) and for the metallurgical treatment, which includes an intake opening (22) for the molten metal and a tapping opening (18), d) a second heating arrangement (38) associated with the treatment vessel for the metallurgical treatment of the molten metal, and e) a passage (26) which connects the discharge flow opening (15) of the melting vessel (1) to the intake opening (22) of the treatment vessel (2) and includes a sole (29) having a height which is higher than the bottom (25) of the melting vessel (1) by an amount that permits transfer of the molten metal (13) from the furnace hearth (12) of the melting vessel (1) to the treatment vessel (2) by way of the passage only when the metallurgic unit is tilted in the positive tilting direction (8), wherein in plan view the connecting line (23) from the center point (17) of the melting vessel (1) to the center point (20) of the treatment vessel (2) includes an acute angel ($\alpha$) relative to the positive tilting direction (8) of the unit.

* * * * *